US005255644A

United States Patent [19]

Mills et al.

[11] Patent Number: 5,255,644

[45] Date of Patent: Oct. 26, 1993

[54] POSITIVE GEAR ENGAGEMENT MECHANISM

[75] Inventors: Floyd D. Mills, Valois; Gregory A. Bartlett, Chemung, both of N.Y.

[73] Assignee: Ingersoll-Rand Company, Woodcliff Lake, N.J.

[21] Appl. No.: 889,937

[22] Filed: Jun. 2, 1992

[51] Int. Cl.[5] ..... F02N 7/08

[52] U.S. Cl. ..... 123/179.310; 74/7 E

[58] Field of Search ..... 123/179.31, 179.25; 60/625, 626, 627; 74/7 E; 290/48

[56] References Cited

U.S. PATENT DOCUMENTS

| | | | |
|---|---|---|---|
| 1,337,973 | 4/1920 | Bijur | 290/48 |
| 1,951,031 | 3/1934 | Nardone | 123/179.31 |
| 1,951,032 | 3/1934 | Nardone | 123/179.31 |
| 2,295,288 | 9/1942 | Nardone | 123/179.31 |
| 3,413,860 | 12/1968 | Heckt | 123/179 |
| 3,791,365 | 2/1974 | Pharr et al. | 123/179 |
| 4,273,085 | 6/1981 | Janik, Jr. | 123/179 |
| 4,495,905 | 1/1985 | Morishita et al. | 123/179 |
| 4,679,533 | 7/1987 | Klie et al. | 123/179 |
| 4,694,791 | 9/1987 | Tanaka | 123/179 |

*Primary Examiner*—Andrew M. Dolinar
*Attorney, Agent, or Firm*—Walter C. Vliet

[57] ABSTRACT

An engine starter having an internal liner which carries forward the motor and gear reducing assembly in unison to engage the engine simultaneously providing a limited power rotation to the pinion and subsequently full power to the engine starter once engaged at movement of the liner performs the valving function to permit the so-called "soft" starter engagement.

10 Claims, 1 Drawing Sheet

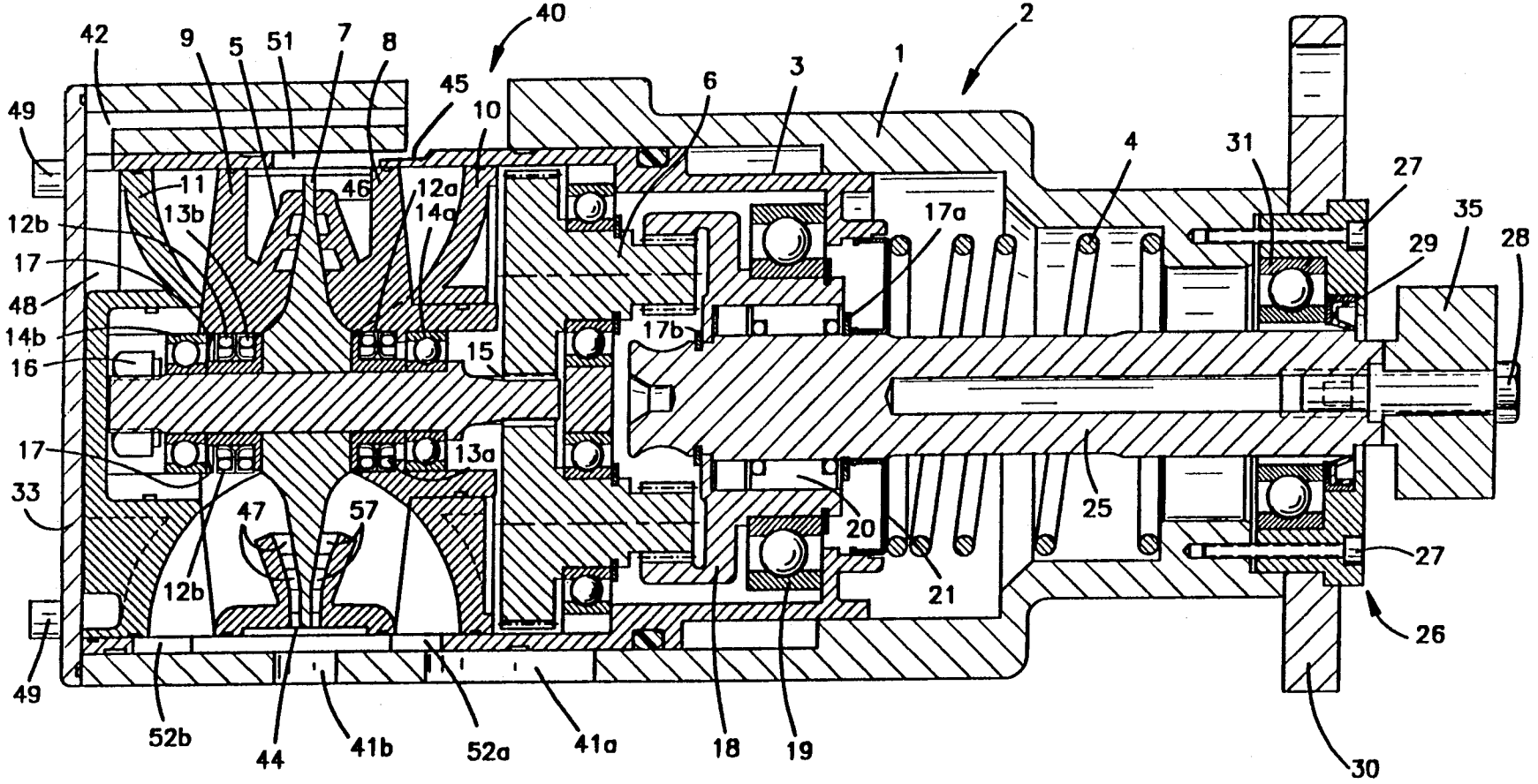
28
35
29
27
27
26
30
31
4
25
2
1
17a
21
20
3
19
6
18
17b
40
41a
10
15
13a
52a
45
12a
14a
8
46
57
41b
7
51
44
5
47
9
11
13b
12b
52b
42
49
12b
17
48
14b
16
17
33
49

POSITIVE GEAR ENGAGEMENT MECHANISM

BACKGROUND OF THE INVENTION

This invention relates generally to starters for engines and the like and more particularly to pneumatically driven starters having an output on a pinion gear which engages an engine flywheel or the like. The invention further relates to so-called "soft" engaging starters including a prestart engaging cycle followed by a full powered start.

In a number of prior art starters the pinion shaft carrying the pinion was extended by several means. Three of these include pneumatically pre-engaged, inertia driven, and electrically pre-engaged. A pneumatically pre-engaged pinion requires extra hoses to shuttle air to a piston. An inertia driven system requires elaborate helical splines. An electric starting system requires a solenoid for engagement, which may be bulky in size, and costly. In addition, either timed or signal operated air solenoids were utilized to accomplish the pre-engagement or soft engagement function.

The foregoing illustrates limitations known to exist in present pneumatic and electric starters. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a positive gear engagement mechanism comprising an elongate casing, an elongate liner mounted for reciprocation within the casing, a motor mounted within the liner having its rotary output transmitted to a pinion for selective engagement with a gear means for rotating the engine, and means for supplying motive media to the motor at a reduced rate in one selected position of the liner and for transporting the liner to a second operating position whereby the pinion engages the gear and the motor receives motive media at an increased rate.

The foregoing and other aspects will become apparent from the following detailed description of the invention when considered in conjunction with the accompanying drawing figures.

BRIEF DESCRIPTION OF THE DRAWING FIGURES

FIG. 1 is a sectional view of the generally cylindrical form starter according to the present invention.

DETAILED DESCRIPTION

Referring to FIG. 1, a positive gear engagement mechanism 1 according to the present invention is generally cylindrical in form having a hollow cylindrical outer housing 2. An inner housing or liner 3 is disposed within the outer housing 2 for longitudinal reciprocation therein. The inner housing or liner 3 has contained within its hollow center a motor 5 and a transmission 6 which in turn drives a drive pinion shaft 25 which extends from the liner 3 through a housing cover 26 which closes one end of the housing 2. The shaft 25 has mounted on its exposed outside end a drive pinion 35 which is retained on the drive shaft 25 by means of a drive pinion screw 28.

By way of further explanation in the form of a preferred embodiment, a pneumatically operated engine starting motor of the radial inward flow type is utilized to power the starter. The air turbine motor 5 is comprised of a front deflector 10 and a rear deflector 11 generally forming the ends of a housing which along with the liner 3 contain the front stator 8 and the rear stator 9.

A rotor 7 is mounted for rotation in front and rear shaft bearings **14*a* and 14*b*, respectively. The bearings are positioned in the front stator 10 and rear stator 11. Suitable rotor shaft seals 12*a* and 12*b* are provided to prevent loss of pressure fluid between the rotor bearing spacers 13*a* and 13*b* and the stators 8 and 9. The rotor 7, bearing spacers 13*a* and 13*b*, rotor shaft seals 12*a* and 12*d*, and shaft bearings 14*a* and 14*b* are assembled on the rotor shaft and maintained thereon by means of a rotor lock nut 16. Proper compression between the seal components is maintained by a wavy washer 17 interspaced between the rear shaft bearing 14*b* and the rear rotor bearing spacer 13*b***.

It should be appreciated by one skilled in the art that air entering the motor through nozzle 44 is expanded through the stator blades 47 against the rotor blades 57 to impart rotation to the rotor and power to drive the starter.

The gear reducer shown is of the conventional idler gear form having its output on a ring gear 18 which is mounted for rotation within the liner 3 by means of a bearing 19. The rotary output of the ring gear is imparted to the shaft 25 through a one way clutch 20 which permits drive in the starting rotation direction only and permits overrun of the drive shaft 25 once the engine has started without overspeed of the remainder of the starter components.

The shaft 25 is retained in the one way clutch 20 and ring gear 18 by means of retainers **17*a* and 17*b*. A shaft seal 21 prevents foreign matter from entering the gear reducing cavity and retains lubricant therein. A return spring 4 is provided to translate the liner 3 and its contained components to the rear of the starter housing 2**.

The drive shaft 25 is positioned within the housing cover 26 by means of a drive shaft bearing 31. The housing cover 26 is secured to the housing 2 by means of cap screws 27. A drive housing seal 29 is provided to prevent foreign matter from entering the starter cavity.

The starter is further mounted to an engine to be started by means of a flange 30 which positions the starter to engage the drive pinion gear with a mating gear on the engine when the pinion shaft 25 is extended from the housing.

The housing 2 is provided with a pneumatic fluid or air inlet 40. A passageway 42 transmits the pressure fluid to a chamber 43 formed at the rear end of the starter between the rear deflector 11 and back plate 33. Back plate 33 is secured to the housing 2 by means of cap screws 49.

It may now be appreciated by one skilled in the art that once pressure fluid is applied to the starter the chamber 43 will become pressurized and will translate the liner 3 towards the front end of the starter against the force of return spring 4 carrying with it the motor 5, gear reducer 6, and shaft 25.

During the initial movement a limited amount of pressure fluid is permitted through restricted passage 45 to enter liner inlet port 51 and circumferential distribution passage 46 which communicates with the nozzles 44. Air passing through the nozzles 44 is expanded through the stator blades 47 and the rotor blades 57 to impart rotation to the rotor 7 as previously described.

Expanded pressure fluid exits the motor by means of exhaust ports 52*a* and 52*b* in the liner 3 and corresponding exhaust holes 41*a* and 41*b*.

In addition to the restricted inlet air flow afforded by the restricted passageway 45, it should be appreciated that on initial operation the rear port 52*b* is blocked by the housing 2 thereby permitting only flow through the forward port 52*a*. This effectively halves the power available until the liner 3 has been translated to the forward position (i.e., to the right as viewed from the right side of the FIG. 1). This permits the drive pinion 35 to encase the flywheel or similar gear of an engine to be started before full power is applied to the starter.

Upon reaching the fully engaged position the inlet port 51 is in register with the inlet 40 and the exhaust ports 52*a* and 52*b* are in register with the exhaust holes 41*a* and 41*b* thereby permitting full flow of pressure fluid through the starter motor and obtaining its full output power during the starting cycle.

Once the engine has started the pressure fluid is removed from inlet 40. Chamber 43 is exhausted rearward through passage 42 and through the motor 5 thereby reducing the pressure in chamber 43 and permitting the return spring 4 to translate the liner to the rear position wherein the cycle is completed.

It should further be appreciated that once the engine has started the one way clutch 20 permits overrunning of the drive pinion without damage until such time as the return spring withdraws the drive pinion 35 from engagement with the engine.

Having described the invention, what is claimed is:

1. A starting system for an engine comprising:

an elongate casing;

an elongate liner mounted for reciprocation within said casing from a first pre-engaged position to a second operating position;

a motor mounted within said liner having its rotary output transmitted to a pinion for selective engagement with a gear means for rotating said engine; and means for supplying motive media to said motor at a reduced rate in said first pre-engaged position of said liner and for transporting said liner to a second operating position whereby said pinion engages said gear and said motor receives motive media at an increased rate.

2. A starting system for an engine according to claim 1, wherein said means for supplying motive media to said motor at a reduced rate comprises a flow restricted receiving port in said liner when said liner is in said first position providing a restricted passageway communicating with said motor to effect limited rotation thereof.

3. A starting system for an engine according to claim 1, wherein said means for supplying motive media to said motor at a reduced rate further comprises a means for restricting an exhaust passageway in the initial starting position and eliminates the restriction in said second operating position.

4. A starting system for an engine according to claim 3, wherein said means for restricting an exhaust passageway effectively reduces available motor power to one-half of its normal output for a given air flow.

5. A starting system for an engine according to claim 1, wherein said motor comprises an air turbine motor.

6. A starting system for an engine according to claim 1, wherein said motor includes a gear reducing means.

7. A starting system for an engine according to claim 1, wherein the connection between said motor and said pinion includes a one way clutch means for preventing overrun of said motor once the engine has started.

8. A starting system for an engine comprising:

an elongate casing forming a cylinder;

an elongate liner containing and entirely supporting within said liner a motor and a gear reducer;

said liner, motor and gear reducer forming an integral piston combination within said elongate casing;

means for reciprocating said piston to selectively engage an engine to be started; and means for reducing initial power output of said motor during said engaging and thereafter providing unrestricted power to accomplish engine starting.

9. A starting system for an engine according to claim 8, wherein said piston means is translated by motive pressure fluid to engagement and returns when motive fluid is removed by spring means.

10. A starting system for an engine according to claim 9, wherein initial operation is accomplished by a means for selectively restricting pressure fluid supply to said motor and a means for selectively restricting exhaust from said motor.

* * * * *